US008613619B1

(12) United States Patent
Couet et al.

(10) Patent No.: US 8,613,619 B1
(45) Date of Patent: Dec. 24, 2013

(54) HUNTER TRAINING SYSTEM

(76) Inventors: Bryan S. Couet, Sioux Falls, SD (US); Keri L. Couet, Sioux Falls, SD (US)

( * ) Notice: Subject to any disclaimer, the term of this patent is extended or adjusted under 35 U.S.C. 154(b) by 304 days.

(21) Appl. No.: 12/845,300

(22) Filed: Jul. 28, 2010

Related U.S. Application Data

(63) Continuation-in-part of application No. 11/566,933, filed on Dec. 5, 2006, now abandoned.

(51) Int. Cl.
*F41A 17/00* (2006.01)
*F41A 33/00* (2006.01)

(52) U.S. Cl.
USPC ..... 434/11; 434/16; 434/20; 434/21; 434/22; 434/24

(58) Field of Classification Search
USPC ..... 434/11, 16, 17, 18, 19, 20, 22, 24
See application file for complete search history.

(56) References Cited

U.S. PATENT DOCUMENTS

| | | | | | |
|---|---|---|---|---|---|
| 2,182,097 | A | | 12/1939 | Schenk | |
| 2,414,083 | A | | 1/1947 | Borden | |
| 3,062,114 | A | | 11/1962 | Palos | |
| 3,688,665 | A | | 9/1972 | Herden | |
| 3,709,124 | A | | 1/1973 | Hunt | |
| 3,785,261 | A | | 1/1974 | Ganteaume | |
| 3,827,061 | A | | 7/1974 | Kellner | |
| 3,877,048 | A | | 4/1975 | Kellner | |
| 3,911,451 | A | * | 10/1975 | Vockenhuber | 396/426 |
| 4,309,095 | A | * | 1/1982 | Buckley | 396/420 |
| 4,439,156 | A | | 3/1984 | Marshall et al. | |
| 4,534,735 | A | | 8/1985 | Allard | |
| 4,619,616 | A | | 10/1986 | Clarke | |
| 4,630,911 | A | | 12/1986 | Paul | |
| 4,654,008 | A | * | 3/1987 | Elmore | 434/16 |
| 4,804,325 | A | | 2/1989 | Willits | |
| 4,824,374 | A | | 4/1989 | Hendry | |
| 4,835,621 | A | * | 5/1989 | Black | 386/358 |
| 4,844,476 | A | | 7/1989 | Becker | |
| 4,907,022 | A | | 3/1990 | Myers | |
| 4,955,812 | A | * | 9/1990 | Hill | 434/16 |
| 4,970,819 | A | * | 11/1990 | Mayhak | 42/70.01 |
| 4,989,024 | A | | 1/1991 | Myers | |
| 5,020,262 | A | * | 6/1991 | Pena | 42/106 |
| 5,026,158 | A | * | 6/1991 | Golubic | 356/252 |

(Continued)

FOREIGN PATENT DOCUMENTS

| | | |
|---|---|---|
| JP | 6317398 | 11/1994 |

*Primary Examiner* — Nikolai A Gishnock
(74) *Attorney, Agent, or Firm* — Jeffrey A. Proehl; Woods, Fuller, Shultz & Smith, P.C.

(57) ABSTRACT

A gun-resembling apparatus having a gunstock and a barrel, a sight aligned with the barrel, a trigger mounted along the gunstock, and image capturing features for capturing targeted images via operating the trigger and safety features incorporated with the image capturing features to teach the student proper gun-handling procedures. The device includes a camera to capture image(s) in a sight line of the barrel. The image(s) are displayed on a display screen for viewing and editing. The device also incorporates a safety switch having a safe and fire position, the camera being prohibited from operating in the safe position and being allowed to operate in the fire position. An alert signal may sound through a speaker if the trigger is not operated after a predetermined time of the safety switch being in the fire position. An image storage device may also be used.

20 Claims, 9 Drawing Sheets

(56) References Cited

U.S. PATENT DOCUMENTS

| | | | | | |
|---|---|---|---|---|---|
| 5,194,006 | A | * | 3/1993 | Zaenglein, Jr. | 434/19 |
| 5,233,776 | A | * | 8/1993 | Hessey | 42/54 |
| 5,246,372 | A | * | 9/1993 | Campagnuolo et al. | 434/11 |
| 5,281,142 | A | | 1/1994 | Zaenglein, Jr. | |
| 5,316,479 | A | * | 5/1994 | Wong et al. | 434/11 |
| H1451 | H | * | 6/1995 | Campagnuolo | 434/11 |
| 5,437,463 | A | | 8/1995 | Fromm | |
| 5,738,522 | A | * | 4/1998 | Sussholz et al. | 434/22 |
| 5,887,375 | A | * | 3/1999 | Watson | 42/106 |
| 5,954,507 | A | * | 9/1999 | Rod et al. | 434/19 |
| 5,988,645 | A | * | 11/1999 | Downing | 273/348 |
| 6,070,355 | A | | 6/2000 | Day | |
| D435,573 | S | | 12/2000 | Harata | |
| 6,192,614 | B1 | * | 2/2001 | Cliburn | 42/106 |
| 6,450,816 | B1 | | 9/2002 | Gerber | |
| 6,616,452 | B2 | | 9/2003 | Clark | |
| 6,739,873 | B1 | | 5/2004 | Rod | |
| 6,813,593 | B1 | | 11/2004 | Berger | |
| 6,942,486 | B2 | * | 9/2005 | Lvovskiy | 434/16 |
| 7,121,464 | B2 | * | 10/2006 | White | 434/16 |
| 7,194,204 | B2 | | 3/2007 | Gordon | |
| 7,255,035 | B2 | | 8/2007 | Mowers | |
| 7,292,262 | B2 | | 11/2007 | Towery | |
| 7,329,127 | B2 | | 2/2008 | Kendir | |
| 7,335,026 | B2 | * | 2/2008 | Goree et al. | 434/22 |
| 7,574,824 | B2 | | 8/2009 | Holmberg | |
| 7,632,187 | B1 | * | 12/2009 | Farley et al. | 463/53 |
| 7,688,219 | B2 | * | 3/2010 | Hudson et al. | 340/686.1 |
| 8,267,691 | B1 | * | 9/2012 | Ferris et al. | 434/11 |
| 8,469,824 | B1 | * | 6/2013 | Farley et al. | 463/53 |
| 2002/0197584 | A1 | * | 12/2002 | Kendir et al. | 434/21 |
| 2004/0257437 | A1 | | 12/2004 | Lesseu | |
| 2005/0123883 | A1 | * | 6/2005 | Kennen et al. | 434/11 |
| 2008/0233543 | A1 | | 9/2008 | Guissin | |
| 2012/0214137 | A1 | * | 8/2012 | Goree et al. | 434/19 |
| 2012/0258432 | A1 | * | 10/2012 | Weissler | 434/20 |

* cited by examiner

HUNTER TRAINING SYSTEM

CROSS REFERENCE TO RELATED APPLICATIONS

I hereby claim benefit under Title 35, United States Code, Section 120 of U.S. patent application Ser. No. 11/566,933 filed Dec. 5, 2006 now abandoned. This application is a continuation in-part of the Ser. No. 11/566,933 application. The Ser. No. 11/566,933 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to guns and more specifically it relates to a hunter training system for efficiently improving gun safety and skills.

2. Description of the Related Art

Any discussion of the related art throughout the specification should in no way be considered as an admission that such related art is widely known or forms part of common general knowledge in the field.

Guns have been in use for years. Typically, gun operators must pass an official gun training class before legally operating a gun. Generally, the training class focuses primarily on bookwork and possibly some light hands on tutorials, thus limiting hands-on training for the student.

It is known that guns can be very dangerous weapons if not handled properly and usually require extensive hands-on training before a hunter is able comfortably operate a gun. Many beginning shooters do not receive adequate hands on training with a gun before they legally start to hunt, wherein generally beginning shooters must use actual guns and ammunition as training devices to become comfortably acquainted with guns. This can pose a serious danger in that if you misfire with live guns and ammunition it can be very dangerous.

While these devices may be suitable for the particular purpose to which they address, they are not as suitable for efficiently improving gun safety and skills. Using live guns and ammunition to develop gun safety and skills can be very dangerous for beginning hunters. In these respects, the hunter training system according to the present invention substantially departs from the conventional concepts and designs of the prior art, and in so doing provides an apparatus primarily developed for the purpose of efficiently improving gun safety and skills.

BRIEF SUMMARY OF THE INVENTION

A system for efficiently improving gun safety and skills. The invention generally relates to a gun training device which includes a gun-resembling apparatus having a gunstock and a barrel, a sight aligned with the barrel, a trigger mounted along the gunstock, and image capturing features for capturing targeted images via operating the trigger, as well as safety features incorporated with the image capturing features to teach the student proper gun-handling procedures. The device includes a camera to capture still or video image(s) in a sight line of the barrel, wherein the image(s) are sent to a display screen for viewing and editing. The device also incorporates a safety switch having a safe and fire position, the camera being prohibited from operating in the safe position and being allowed to operate in the fire position. An alert signal sounds through a speaker if the trigger is not operated after a predetermined time of the safety switch being in the fire position. A power supply and image storage device are also used.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
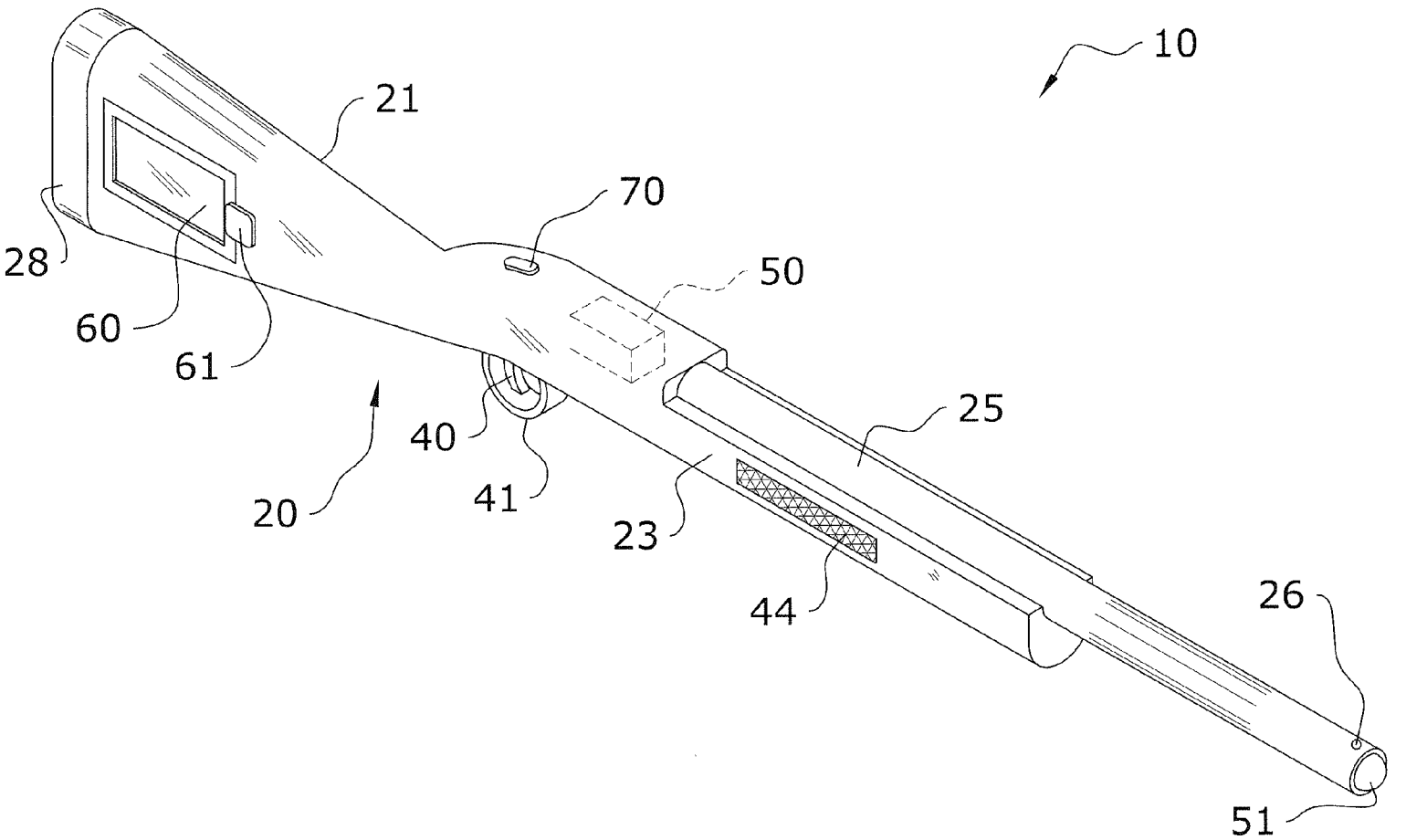
FIG. 1 is a first upper perspective view of the invention.
Figure 2:
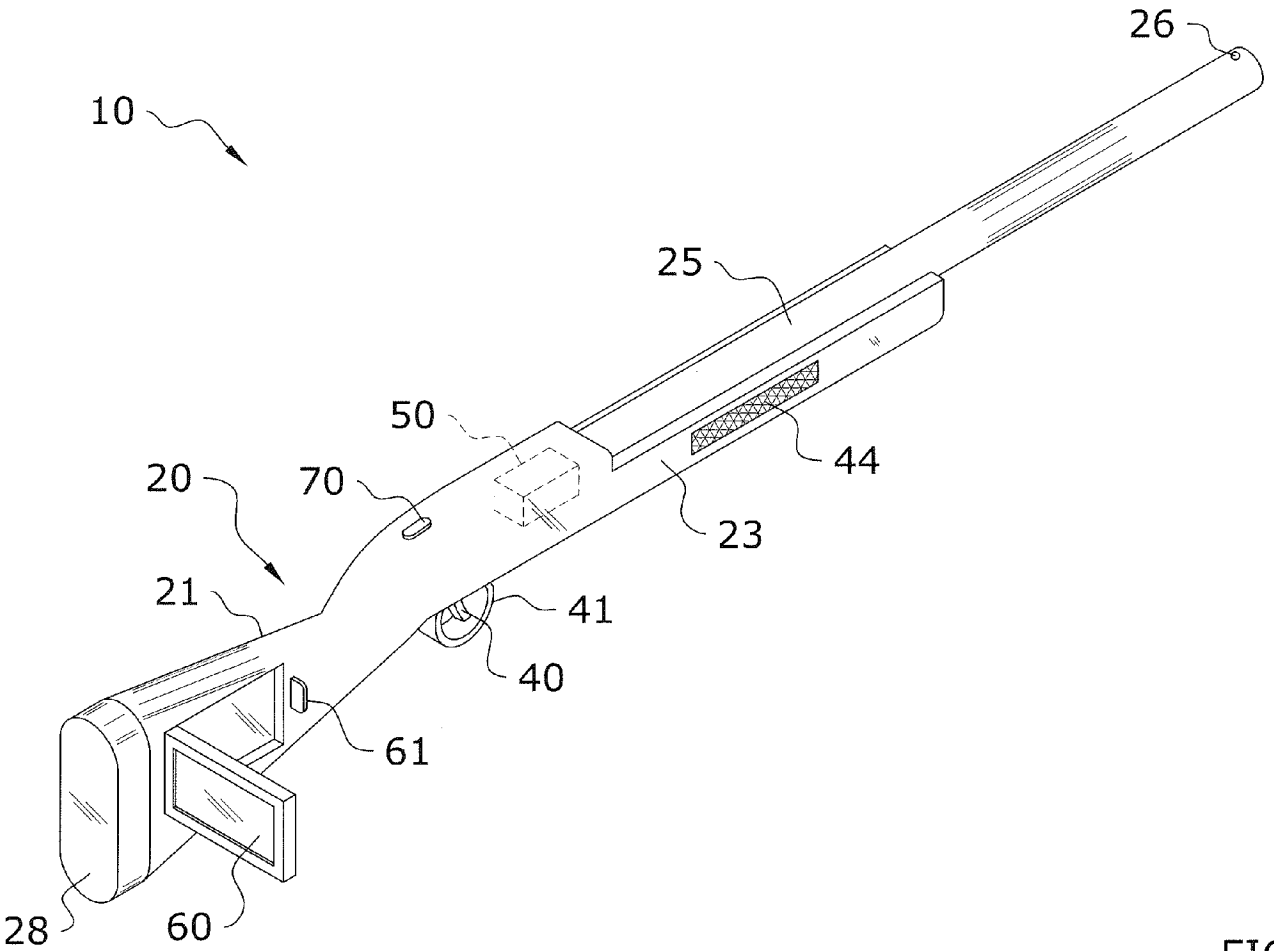
FIG. 2 is a second upper perspective view of the invention with the screen pivoted.

A. Overview.

Turning now descriptively to the drawings, in which similar reference characters denote similar elements throughout the several views, FIGS. 1 through 9 illustrate a hunter training system 10, which comprises a gun-resembling apparatus having a gunstock 20 and a barrel 25, a sight 26 aligned with the barrel 25, a trigger 40 mounted along the gunstock 20, and image capturing features for capturing targeted images via operating the trigger 40, as well as safety features incorporated with the image capturing features to teach the student proper gun-handling procedures, wherein the device 10 may include one or more internal processors 30 for controlling and directing electrical signals from the image capturing features and safety features. The processor 30 may also be used for image compression, storage features, etc.

Figure 9:
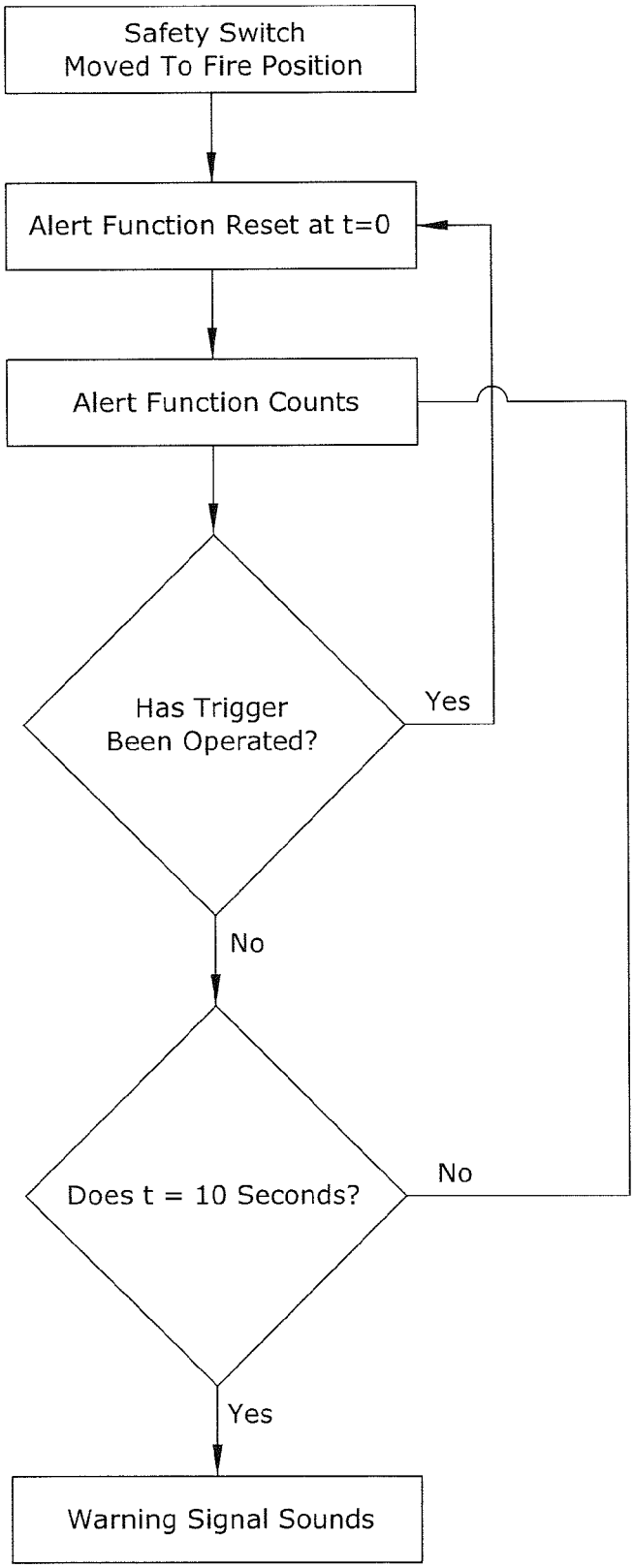
FIG. 9 is a flow chart of an exemplary process of using the alert function.

The device 10 includes a camera 50 to capture still or video image(s) in a sight 26 line of the barrel 25, wherein the image(s) are sent to a display screen 60 for viewing and editing. The device 10 also incorporates a safety switch 70 having a safe and fire position, the camera 50 being prohibited from operating in the safe position and being allowed to operate in the fire position. A warning signal from the alert function of the processor 30 sounds through a speaker 44 if the trigger 40 is not operated after a predetermined time of the safety switch 70 being in the fire position as illustrated in FIG. 9.

A power supply 28 and image memory device 54 are also preferably used. The power supply 28 may be comprised of a battery (e.g. rechargeable, non-rechargeable) and may be external or internal to the device 10, such as positioned at the end of the butt portion 21 to resemble padding or within the fore-end portion 23. The device 10 is generally self-contained to include all necessary equipment to capture and review images, as well as provide safety features.

B. Gun-Resembling Apparatus.

The gunstock 20 is constructed to resemble a conventional firearm and preferably a firearm resembling a shotgun or rifle. The gunstock 20 may further be constructed to resemble various types of actions, such as pump-style, lever, automatic, semi-automatic, etc. The gunstock 20 is preferably comprised of a material common with gun stocks, such as but not limited to wood or plastic; however the gunstock 20 may be comprised of various other materials.

The gunstock 20 includes a butt portion 21 and a fore-end portion 23 extending forwardly from the butt portion 21, wherein the butt portion 21 makes up the rear of the gunstock 20 and the fore-end portion 23 makes up the forward end of the gunstock 20. The butt portion 21 also includes a grip portion 22 at a forward end of the butt portion 21 for the user to grip when not engaging the trigger 40.

The barrel 25 is generally mounted to the forward part of the fore-end portion 23 of the gunstock 20 on an upper side. The barrel 25 is elongated and tubular in structure and generally resembles a barrel 25 of a conventional firearm, such as a shotgun or rifle. The barrel 25 may be comprised of various materials, such as metal, plastic, etc. At the end of the barrel 25 is generally a sight 26. The sight 26 is aligned with the barrel 25 and is used for aiming the barrel 25. The sight 26 may be colored in various manners. Other types of sights may be used traditional with standard firearms to aim the barrel 25, such as lasers or scopes.

C. Trigger.

The trigger 40 generally extends from a downward side of the gunstock 20 at the rearward end of the fore-end portion 23 of the gunstock 20 forwardly of the grip portion 22. The trigger 40 may have a guard 41 surrounding thereof and typically operates in a conventional trigger manner, wherein the operator pulls back upon the trigger 40 to fire the device 10. The trigger 40 is connected to the camera 50, generally through one or more internal processors 30, to fire the camera 50 and thus capture an image(s).

D. Speaker.

The speaker 44 is generally located at the butt portion 21 of the gunstock 20; however the speaker 44 may be located at the fore-end portion 23 as appreciated. The speaker 44 is generally electrically connected to the trigger 40, such as through the processor 30 to emit an audible sound to simulate a gunshot when the trigger 40 is operated (i.e. pulled). The speaker 44 is also generally connected to the safety switch 70 to be restricted from emitting an audible sound if the safety switch 70 is in the safe position, wherein the speaker 44 is only able to emit the audible firing sound when the safety switch 70 is in the fire position. The processor 30 also preferably allows the ability for the user to modify or change the sound emitted from the speaker 44 when the trigger 40 is operated.

E. Camera.

The camera 50 is connected to the trigger 40 to fire when the trigger 40 is operated. Generally, the processor 30 electrically connects the camera 50 to the trigger 40; however it is appreciated that the camera 50 may be connected to the trigger 40 in various manners all which allow the firing (i.e. taking of a snapshot or video) of the camera 50 activatable by operating the trigger 40. One or more images may be acquired each time the trigger 40 is pulled. Generally, the user is allowed to pull the trigger 40 up to 3 times with a minimum of 1 second intervals to simulate rapid fire. Additionally, the lead time to simulate shot time-of-flight may be preset as desired. The lead time in the present invention is the time between when the trigger 40 is operated to when the image is captured. The camera 50 may also include a flash or other common camera features.

Figure 3:
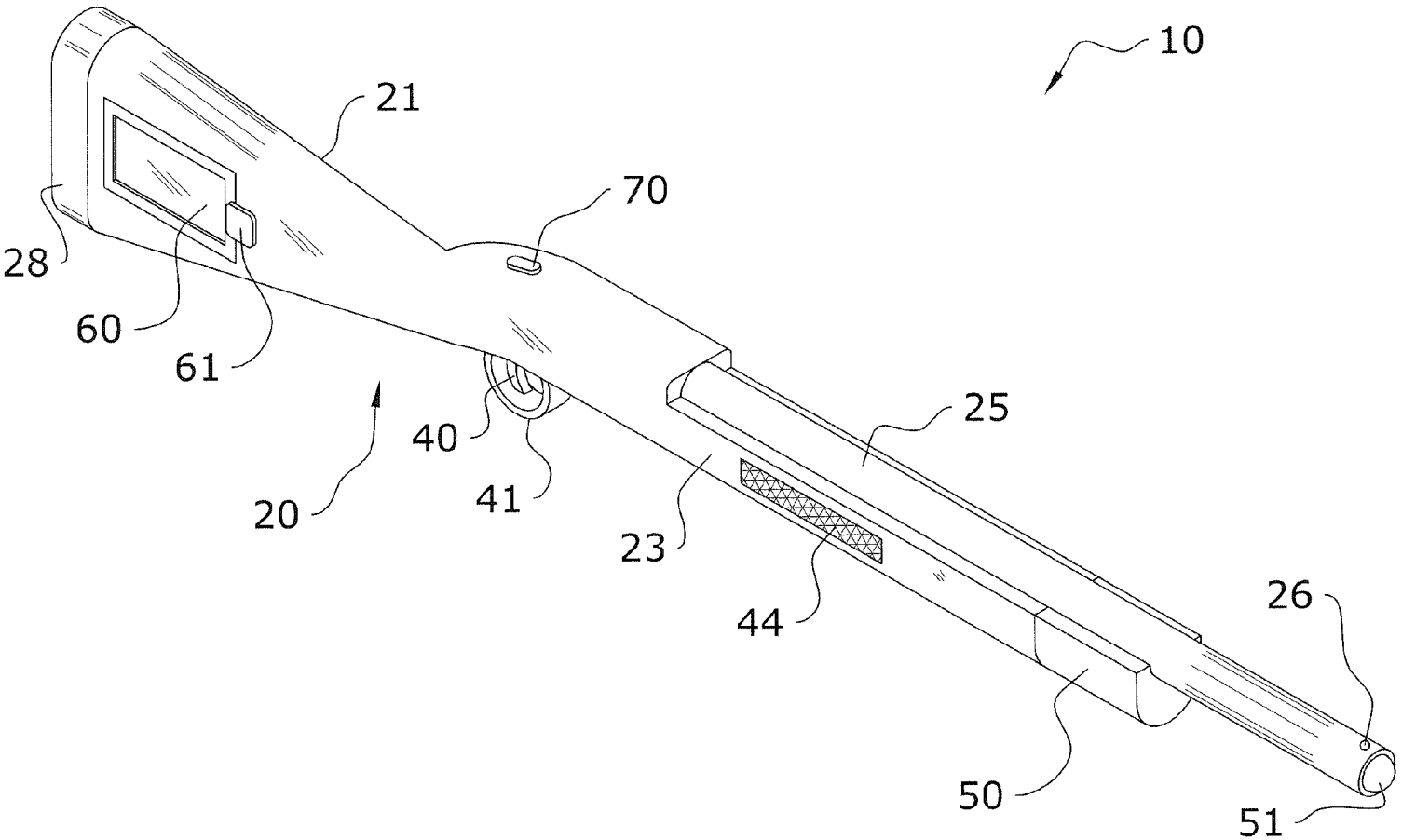
FIG. 3 is an upper perspective view of an alternative embodiment of the invention with the camera external to the gunstock.
Figure 4:
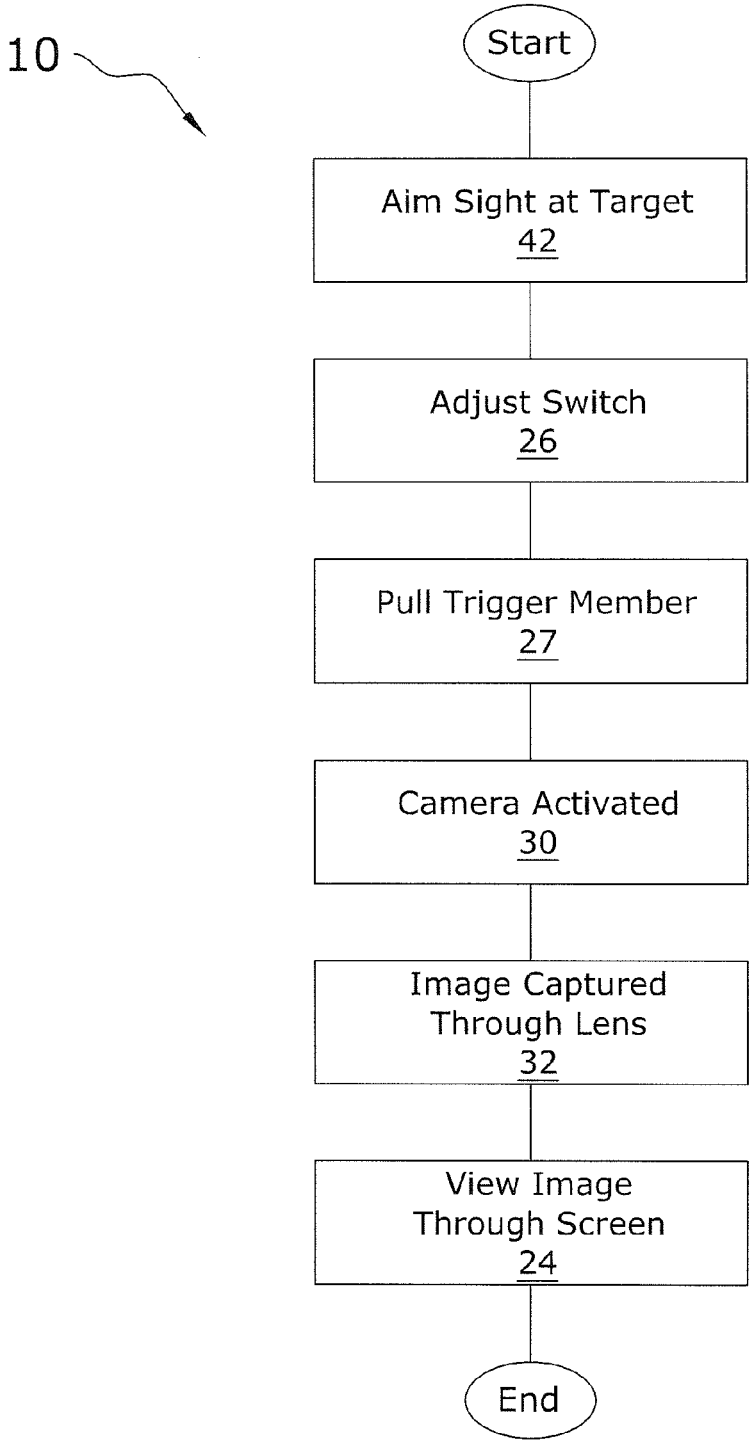
FIG. 4 is a flow chart of an exemplary process of using the invention.
Figure 5:
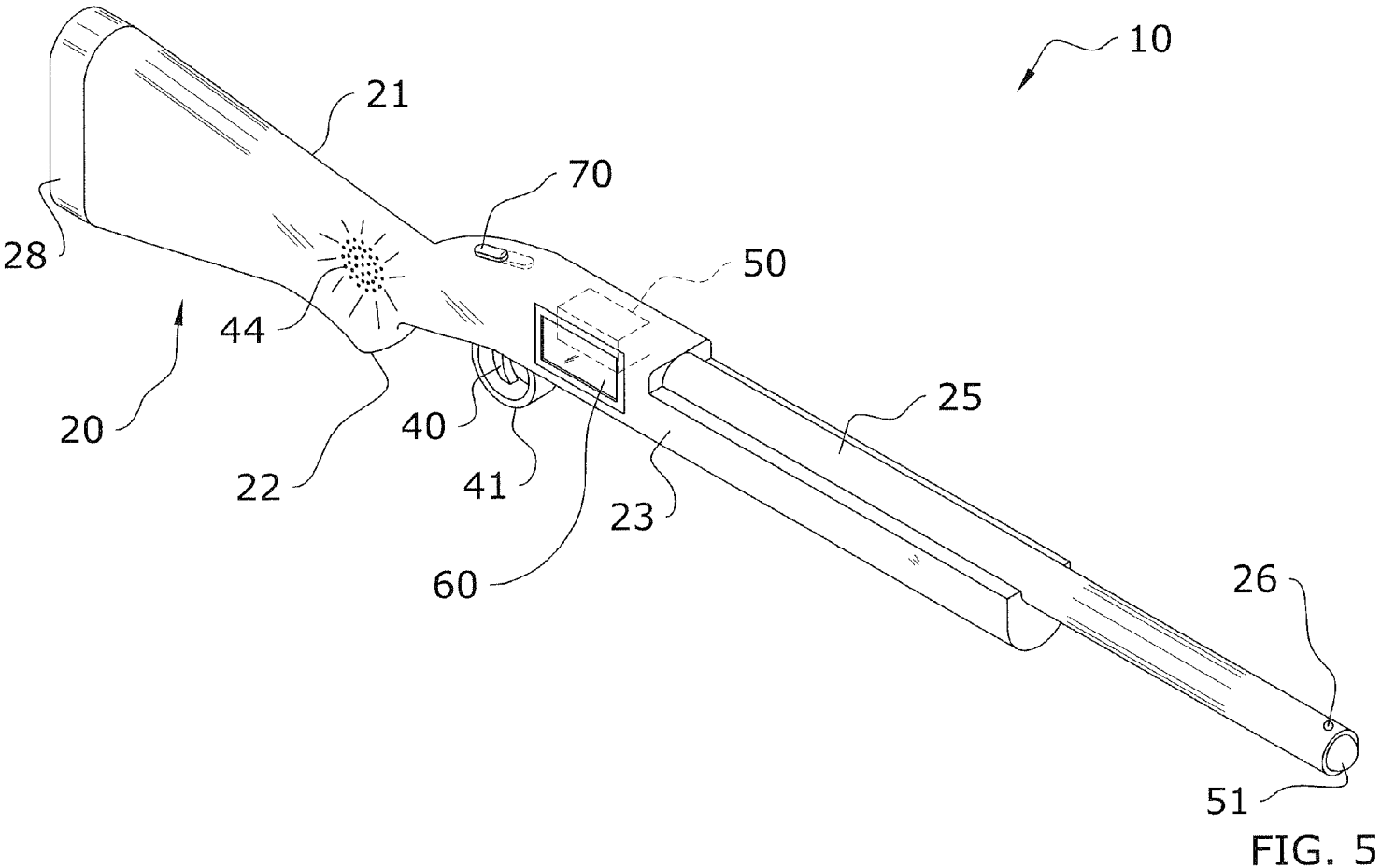
FIG. 5 is an upper perspective view of another alternate embodiment of the invention.
Figure 6:
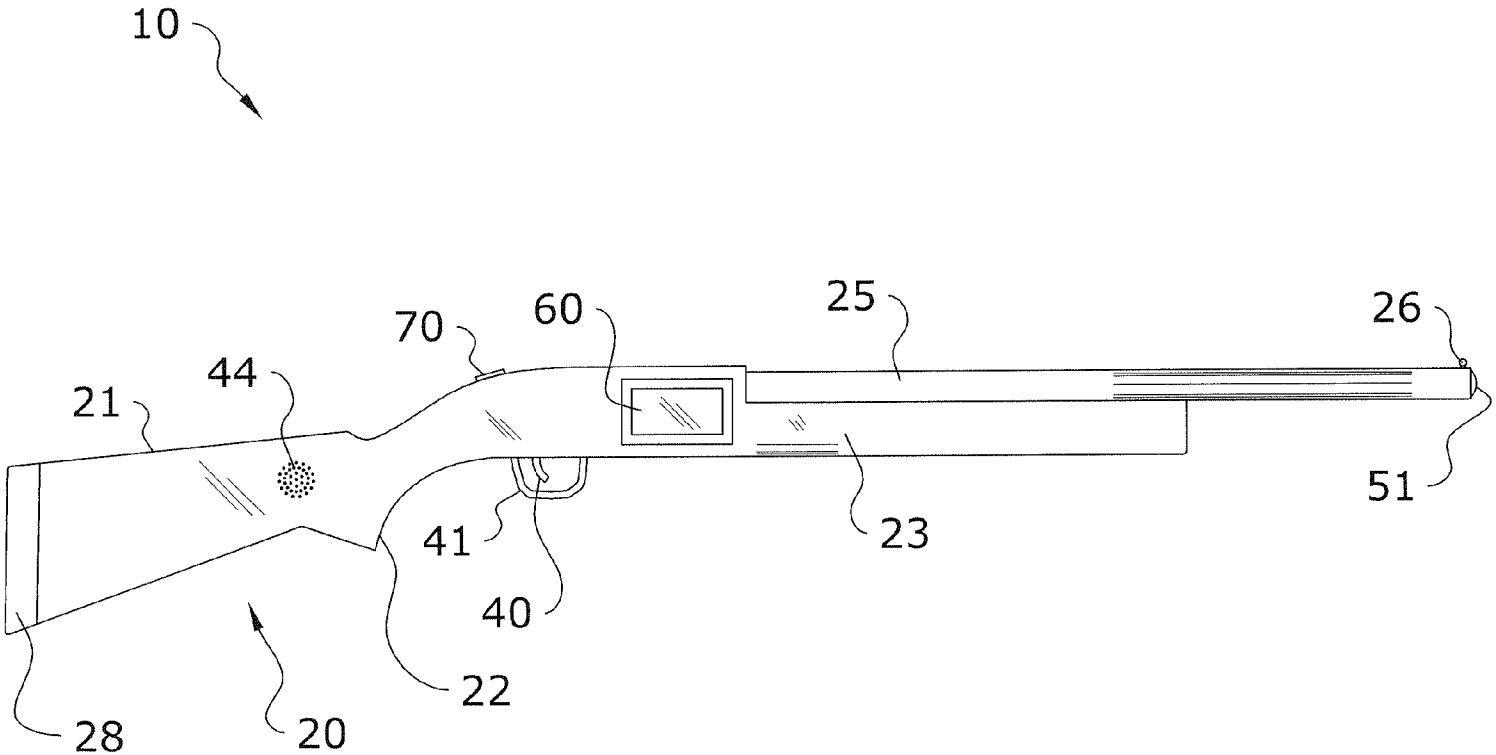
FIG. 6 is a side view of the alternate embodiment of the invention shown in FIG. 5.
Figure 7:
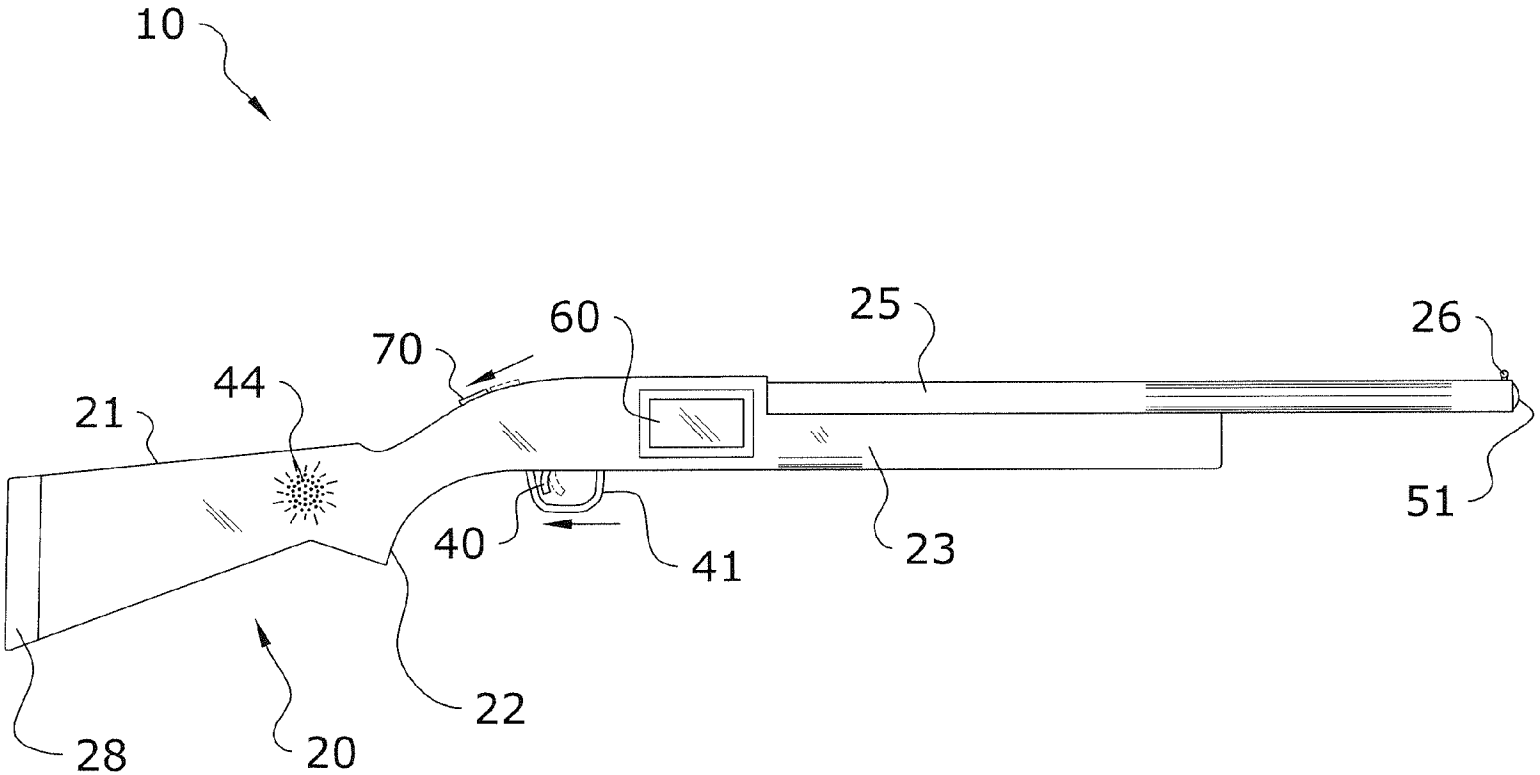
FIG. 7 is a side view of the alternate embodiment of the invention shown in FIG. 5 with the safety switch moved to the fire position and the trigger operated.
Figure 8:
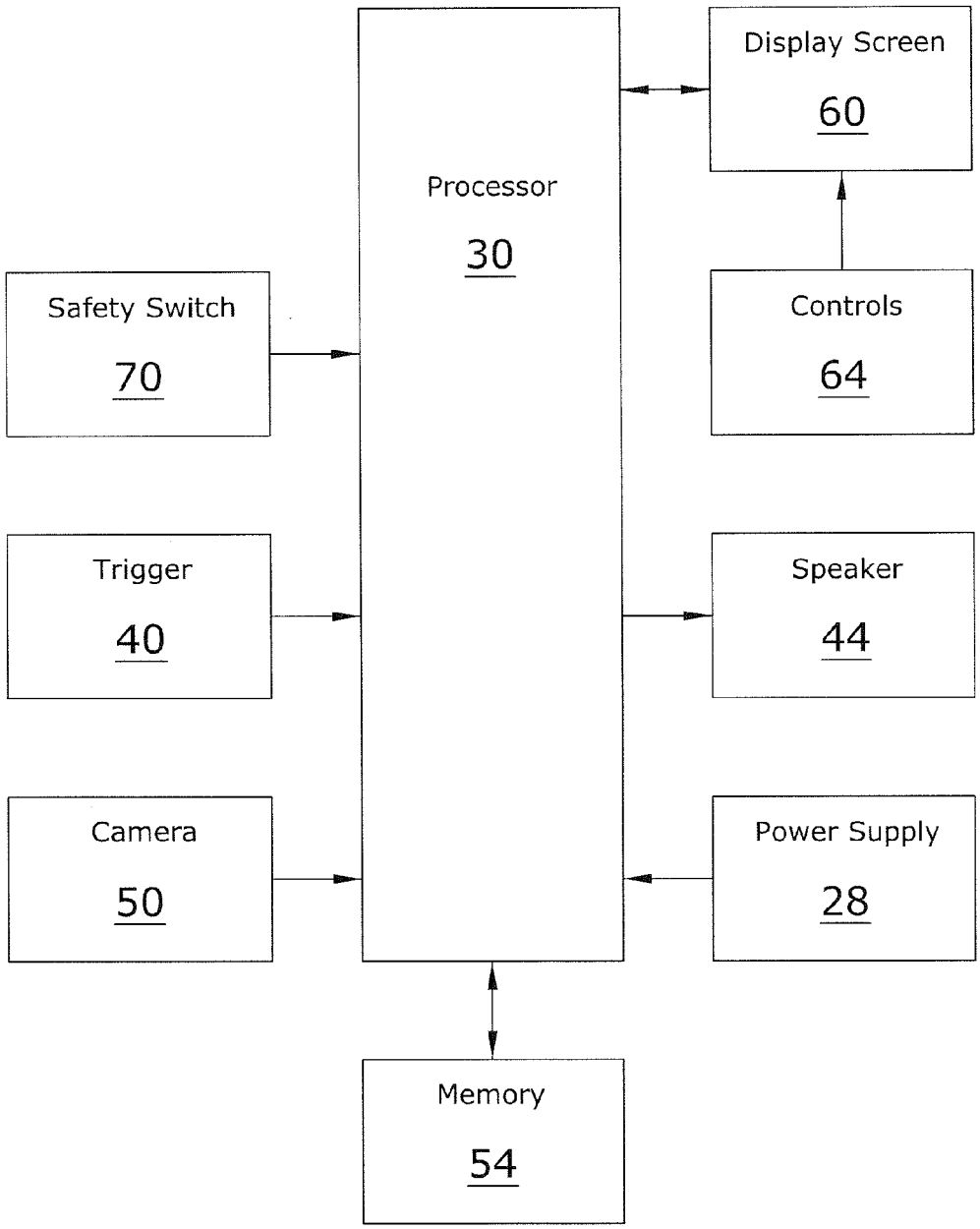
FIG. 8 is an exemplary block diagram of the processor connectivity.

The camera 50 is generally located internal to the gunstock 20, such as in the fore-end portion 23 or in the butt portion 21. It is appreciated that a portion or the entire camera 50 may be external to the gunstock 20 as illustrated in FIG. 3; however the camera 50 is generally substantially concealed by the gunstock 20 as illustrated in FIG. 1 and is operable via operating the trigger 40 in a firing manner. The camera 50 is generally comprised of a digital camera 50 and has a lens 51 that is positioned adjacent the distal end of the barrel 25 to optimally capture a target. Generally, the camera 50 and lens 51 are able to capture image(s) a sufficient distance from the device 10 to simulate a real-life shot, such as but not limited to at least 40 yards.

F. Memory.

The camera 50 may have various types of memory devices 54, such as internal or external. The memory device 54 may be removed from the gunstock 20 or may be integrally formed within the gunstock 20 and retrieved in various manners. In a preferred embodiment, a flash or memory card is utilized as the memory device 54 and the memory device 54 is removable from the gunstock 20 or device 10. Additionally, different sounds for the warning signal or trigger 40 may be uploaded to the processor 30 for use via the memory device 54.

G. Display Screen.

The display screen 60 is adapted to preferably immediately portray the image(s) captured by the camera 50. The display screen 60 is generally communicatively connected to the camera 50 via the processor 30. The display screen 60 is generally comprised of a flat-panel structure and the reviewing and editing controls 64 (e.g. zoom, forward, reverse, delete) for the captured image(s) are generally comprised of a touch-screen structure and upon the display screen 60. It is appreciated that external controls 64 (to the screen 60) may be utilized.

The display screen 60 is generally flush with the exterior of the gunstock 20, such as along the fore-end portion 23 or along the butt portion 21. The display screen 60 may be fixed within the gunstock 20, may be removable, slidably connected, or may pivot relative the gunstock 20. The display screen 60 is preferably oriented so that the user must orient the barrel 25 and gunstock 20 upwards to view the image(s) upon the display screen 60 that are captured from the camera 50. In the pivoting or removal embodiment of the display screen 60, a catch 61 (e.g. hooks, snaps, etc.) may be utilized to lock the display screen 60 flush or substantially flush with the gunstock 20.

The display screen 60 may have various resolutions. Generally, a cross-hair, bulls-eye, etc. may be illustrated upon the captured image upon the display screen 60 to illustrate a hit-point. Additionally, a date and time may be illustrated upon the display screen 60 to illustrate a date and time of an image capture. The display screen 60 may also display warnings to the user, such as when the safety switch 70 is in the fire position.

H. Safety Switch.

The safety switch 70 is structured to mimic a standard firearm safety switch 70 and is operable in a similar manner. The safety switch 70 is connected to the processor 30 to communicate or control 64 the usage of the trigger 40, camera 50, and display screen 60 via the processor 30. Generally, the safety switch 70 is adjacent the trigger 40 similar to a conventional firearm. The safety switch 70 may be a conventional rocker switch, push button, or various other types.

The safety switch 70 is operable between a safe position and a fire position. When in the safe position, the trigger 40 is disabled to prevent the trigger 40 from activating the camera 50 and prevent the user from capturing image(s) with the camera 50 when the trigger 40 is operated or attempted to be operated. Also, the display screen 60 is fully functional to view and edit captured image(s) when the safety switch 70 is in the safe position. When in the fire position, the trigger 40 is activated to permit the trigger 40 to cause the camera 50 to capture an image(s) when the trigger 40 is operated. Subsequently, the display screen 60 is prohibited from being operated and the user is prohibited from viewing or editing pictures when the safety switch 70 is in the fire position.

The safety switch 70 is also connected to an alert function as detailed in FIG. 9. The alert function may be integral with the processor 30 and is generally additionally connected to the trigger 40 and the speaker 44 through the processor 30. The alert function alerts the user if the safety switch 70 is in the fire position for a predetermined duration without the trigger 40 being operated, thus teaching the user to only move the safety switch 70 to the fire position just prior to shooting.

If the safety switch 70 is in the fire position for the duration, the alert function emits a warning signal (e.g. repetitive beeping) which is turned off by moving the safety switch 70 to the safe position. The warning signal is generally comprised of an audible alert which may be sounded through the speaker 44; however other alerting means may be utilized.

The duration or delay between the operatively moving the safety switch 70 to the fire position and the emitting of the warning signal is preferably approximately 10 seconds; however other time durations may be appreciated. If the trigger 40 is operated prior to the expiration of the time delay (i.e. 10 seconds), the count upon the alert function is reset to t=0 and the count starts again. This process is repeated until the safety switch 70 is moved to the safe position.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A firearm training device, comprising:

a gun-resembling apparatus having a gunstock and a barrel;

a sight device mounted on the barrel and being aligned with a sight line of said barrel;

a trigger mounted along said gunstock;

an image capturing assembly on said gun-resembling apparatus and being operatively connected to said trigger, said image capturing assembly being adapted to capture into memory at least one image in the sight line of said barrel when said trigger is operated;

a safety switch on said gun-resembling apparatus and being operatively connected to said image capturing assembly, said safety switch having a safe position and a fire position, the safe position of said safety switch being characterized by disabling the trigger and thereby preventing said image capturing assembly from capturing an image when said trigger is operated; and the fire position of said safety switch being characterized by enabling the trigger and thereby permitting said image capturing assembly to capture at least one image when said trigger is operated; and an image display connected to said image capturing assembly, said image display being adapted to display from memory at least one of said images captured by said image capturing assembly;

wherein the image display is enabled, when the safety switch is in the safe position, to thereby permit display of at least one of said images captured by said image capturing apparatus with the safety switch in the fire position, and wherein the image display is disabled, when the safety switch is in the fire position, to thereby prevent display of captured images so that the user is unable to view captured images when the safety switch is in the fire position.

2. The firearm training device of claim 1, including an alert device being connected to said safety switch, said alert device having an off condition corresponding to said safe position of said safety switch and an on condition corresponding to said fire position of said safety switch;

wherein said alert device is configured to emanate a warning signal when said alert device is in said on condition after a predetermined delay period beginning at initiation of said on condition by moving the safety switch into said fire position.

3. The firearm training device of claim 2, wherein said alert device includes a delay function, said delay function adapted to delay activation of said warning signal when said alert means is in said on position by a delay period.

4. The firearm training device of claim 3, wherein said delay period is approximately 10 seconds.

5. The firearm training device of claim 2, wherein said warning signal is comprised of an audible alert.

6. The firearm training device of claim 1, wherein said image capturing assembly includes a camera, said camera being mounted internal to said gunstock.

7. The firearm training device of claim 6, wherein said image capturing assembly includes a lens, said lens being mounted adjacent a distal end of said barrel.

8. The firearm training device of claim 1, wherein said image display is mounted flush with said gunstock.

9. The firearm training device of claim 1, further comprising controls associated with said image display for editing and reviewing an image captured by said image capturing assembly.

10. The firearm training device of claim 1, including an audible sound emitter connected to said trigger for producing a sound when said trigger is operated.

11. The firearm training device of claim 1, including an image storage device connected to said image capture assembly for electronically storing images.

12. A firearm training device, comprising:

a gun-resembling apparatus having a gunstock and a barrel;

a sight device mounted on the barrel and being aligned with a sight line of said barrel;

a trigger mounted along said gunstock;

an image capturing assembly on said gun-resembling apparatus and being operatively connected to said trigger, said image capturing assembly being adapted to capture at least one image in the sight line of said barrel when said trigger is operated;

a safety switch on said gun resembling apparatus and being operatively connected to said image capturing assembly, said safety switch having a safe position and a fire position, said safety switch operative to prohibit said image capturing assembly from capturing at least one image when in said safe position and said safety switch being operative to allow said image capturing assembly to capture at least one image when in said fire position;

an image display connected to said image capturing assembly, said image display being adapted to display at least one image captured by said image capturing assembly;

an alert device being connected to said safety switch, said alert device having an off condition corresponding to said safe position of said safety switch and an on condition corresponding to said fire position of said safety switch;

wherein said alert device is configured to emanate a warning signal when said alert device is in said on condition after a predetermined delay period, said delay period beginning at initiation of said on condition by moving the safety switch from said safe position to said fire position, said alert device being configured to stop emanating the warning signal when the safety switch is moved from said fire position to said safe position.

13. The firearm training device of claim 12, wherein said delay period is approximately 10 seconds.

14. The firearm training device of claim 12, wherein said image capturing assembly includes a camera, said camera being mounted internal to said gunstock and wherein said image capturing assembly includes a lens, said lens being mounted adjacent a distal end of said barrel.

15. The firearm training device of claim 12, further comprising controls associated with said image display for editing and reviewing images captured by said image capturing assembly.

16. The firearm training device of claim 12, including an audible sound emitter connected to said trigger for producing a sound when said trigger is operated.

17. The firearm training device of claim 12, including an image storage device connected to said image capture assembly for electronically storing images captured by said image capture assembly, said image storage device is internal to said gunstock.

18. The firearm training device of claim 12, wherein said trigger is configured to restart the predetermined delay period when the trigger is actuated by the user.

19. The firearm training device of claim 12, wherein the safe position of said safety switch is characterized by disabling the trigger and thereby preventing said image capturing assembly from capturing an image when said trigger is operated; and the fire position of said safety switch being characterized by enabling the trigger and thereby permitting said image capturing assembly to capture at least one image-when said trigger is operated;

wherein the image display is enabled, when the safety switch is in the safe position, to thereby permit display of at least one of said images captured by said image capturing apparatus with the safety switch in the fire position, and wherein the image display is disabled, when the safety switch is in the fire position, to thereby prevent display of captured images so that the user is unable to view captured images when the safety switch is in the fire position.

20. A firearm training device, comprising:

a gun-resembling apparatus having a gunstock and a barrel to resemble a gun and being inoperative to fire projectiles;

a sight mounted on and aligned with the barrel to define a sight line;

a trigger mounted on the gunstock;

an image capturing assembly operatively connected to the trigger, the image capturing assembly being configured to capture an image in a sight line of the barrel when the trigger is operated;

a safety switch operatively connected to the image capturing assembly, the safety switch having a safe position and a fire position, the safety switch being configured to prevent the image capturing assembly from capturing an image when in the safe position and the safety switch being configured to permit the image capturing assembly to capture an image when in the fire position;

an image display connected to the image capturing assembly, the image display being configured to display the image captured by the image capturing assembly;

an alert device being connected to said safety switch, said alert device having an off condition corresponding to said safe position of said safety switch and an on condition corresponding to said fire position of said safety switch;

wherein said alert device is configured to emanate a warning signal when said alert device is in said on condition after a predetermined delay period, said delay period beginning at initiation of said on condition by moving the safety switch from said safe position to said fire position, said alert device being configured to stop emanating the warning signal when the safety switch is moved from said fire position to said safe position.

* * * * *